US008365667B2

(12) United States Patent
Marietta

(10) Patent No.: US 8,365,667 B2
(45) Date of Patent: Feb. 5, 2013

(54) REUSABLE FIREWORKS LAUNCHER WITH REINFORCING SLEEVE

(75) Inventor: Michael Marietta, Pittsburg, KS (US)

(73) Assignee: Jake's Fireworks Inc., Pittsburg, KS (US)

( * ) Notice: Subject to any disclaimer, the term of this patent is extended or adjusted under 35 U.S.C. 154(b) by 0 days.

(21) Appl. No.: 13/157,613

(22) Filed: Jun. 10, 2011

(65) Prior Publication Data

US 2012/0312185 A1 Dec. 13, 2012

(51) Int. Cl.
*F42B 4/20* (2006.01)

(52) U.S. Cl. ..... 102/358; 102/343; 102/349; 248/146; 248/346.03; 248/519

(58) Field of Classification Search ..... 102/335, 102/336, 341, 342, 343, 347, 349, 351, 357, 102/358, 361; 248/127, 146, 346.01, 346.03, 248/519

See application file for complete search history.

(56) References Cited

U.S. PATENT DOCUMENTS

| | | | | | |
|---|---|---|---|---|---|
| 1,770,921 | A | | 7/1930 | Hitt | |
| 1,773,197 | A | | 8/1930 | Mulcahy | |
| 2,103,936 | A | | 12/1937 | Decker | |
| 5,117,328 | A | * | 5/1992 | Bilodeau | 403/280 |
| 5,429,053 | A | * | 7/1995 | Walker | 102/342 |
| 5,627,338 | A | | 5/1997 | Poor et al. | |
| 5,668,341 | A | * | 9/1997 | Reynolds et al. | 89/1.35 |
| 5,739,462 | A | | 4/1998 | Poor et al. | |
| 5,979,329 | A | * | 11/1999 | Collar | 102/361 |
| 6,286,429 | B1 | * | 9/2001 | Marietta et al. | 102/342 |
| 6,393,990 | B1 | * | 5/2002 | Fagan | 102/342 |
| 6,412,418 | B1 | * | 7/2002 | Shelton | 102/349 |
| 6,457,415 | B1 | * | 10/2002 | Peter Sung Yan | 102/361 |
| 6,851,371 | B1 | * | 2/2005 | Wah | 102/343 |
| D541,898 | S | | 5/2007 | Marietta | |
| 7,237,488 | B2 | * | 7/2007 | Duescher et al. | 102/349 |
| 7,261,037 | B2 | * | 8/2007 | Joseph, Jr. | 102/347 |
| 7,757,607 | B1 | * | 7/2010 | Deye | 102/206 |
| 7,905,169 | B2 | * | 3/2011 | Travis | 89/1.51 |

OTHER PUBLICATIONS

Article from American Fireworks News (undated) entitled "Destructive Testing and Field Experience with HDPE Mortars," 1 page.
PGI Bulletin No. 54; Winter 1986-87, pp. 5-10, entitled "HDPE Motars for Electrically Fired Displays," 6 pages.

* cited by examiner

*Primary Examiner* — James Bergin
(74) *Attorney, Agent, or Firm* — Hovey Williams LLP

(57) ABSTRACT

An improved, multiple-use fireworks launcher (10) is provided for the launching of fireworks such as an artillery shell (40) having a lower lift charge (42) and an upper effect charge (44). The launcher (10) includes a base (12), with an upstanding, open-top launch tube (14) operably coupled with the base (12). A reinforcing section (16) is positioned about the lower end of launch tube (14), and preferably comprises a tubular sleeve (36) tightly secured to the outer surface (32) of launch tube (14). The combined thickness of the tube (14) and section (16) are sufficient to prevent catastrophic failure of the launcher (10) in the event a shell (40) is improperly placed within the tube (14) in an inverted condition with the lift charge (42) thereof positioned over the effect charge (44).

20 Claims, 3 Drawing Sheets

REUSABLE FIREWORKS LAUNCHER WITH REINFORCING SLEEVE

BACKGROUND OF THE INVENTION

The present invention is concerned with fireworks launchers of the type commonly used in the launching of consumer fireworks. More particularly, the invention is concerned with reusable fireworks launchers for use with fireworks artillery shells.

Fireworks have long provided entertainment to viewers by their colorful displays. "Fireworks" generally means "consumer fireworks" as defined by federal regulations in the form of small devices designed to produce visible effects in night skies. One class of consumer fireworks is artillery shells, which include a lift charge and an effect charge; as the name implies, the lift charge, when ignited, is operable to propel the effect charge into the night sky, whereupon the effect charge is ignited to give the desired display. These shells may be manufactured in place within a cardboard or other single-use launcher, or may be placed in a reusable launcher by a user. Reusable fireworks launchers were previously manufactured from metal, but this proved to be very expensive. Accordingly, modern day launchers are generally constructed using synthetic resin materials. See e.g., U.S. Pat. No. 6,286,429.

When an artillery shell is properly placed within a reusable fireworks launcher, the lift charge is at the bottom of the tube and the effect charge is positioned above the lift charge. In such proper placements, conventional launchers are suitable. However, it sometimes happens that a user will inadvertently place an artillery shell within a launcher in an inverted condition, with the lift charge above the effect charge. Ignition of such an improperly placed shell creates very significant, potentially destructive forces which can rupture the launcher adjacent the base thereof, which presents a hazard to users and spectators in the immediate vicinity of the launcher.

There is accordingly a need in the art for improved fireworks launchers which are operable to launch properly placed artillery shells and which are constructed so as to resist destructive forces occasioned by an improper, inverted insertion of an artillery shell.

SUMMARY OF THE INVENTION

The present invention overcomes the problems outlined above, and provides improved fireworks launchers designed for launching artillery shells that have a lift charge and an effect charge. The launchers of the invention are equipped with a reinforcing section adjacent the base thereof which serves to maintain the structural integrity of the launcher even in the event of inadvertent misuse thereof.

Broadly speaking, a fireworks launcher in accordance with the invention includes a base, with an upright, open-top launch tube operably coupled with the base and configured to receive and launch successive artillery shells. The launch tube is in the form of a tubular wall presenting an upper open end remote from the base, and inner and outer surfaces defining the wall thickness. A reinforcing section is provided adjacent the launcher base and in surrounding relationship to a portion of the tubular wall above the base. The launcher is operable to permit ignition and launching of an artillery shell properly placed within the launch tube with the lift charge beneath the effect charge. Moreover, the combined thickness of the tubular wall and reinforcing section is sufficient to withstand potential destructive forces generated within the launch tube in order to maintain the structural integrity of the launcher, even in the event that an artillery shell is improperly placed within the launch tube and ignited in an inverted condition with the lift charge above the effect charge.

In preferred forms, the reinforcing section comprises a tubular body or sleeve having an inner surface in close conforming engagement with the tubular wall outer surface; advantageously, the inner surface of the tubular body is adhesively connected with the tubular wall outer surface. In order to obtain maximum strength coupled with ease of manufacture, the launch tube and reinforcing section are preferably formed of high density polyethylene. It has been determined that the height of the reinforcing section should be at least about 20% of the total height of the launch tube, and that the combined thickness of the launch tube and reinforcing section should be at least about 40% greater than the launch tube wall thickness.

BRIEF DESCRIPTION OF THE DRAWINGS

In the accompanying drawings which form part of the specification and in which like reference numerals are used to indicate like parts in the various views.

DETAILED DESCRIPTION

Figure 3:
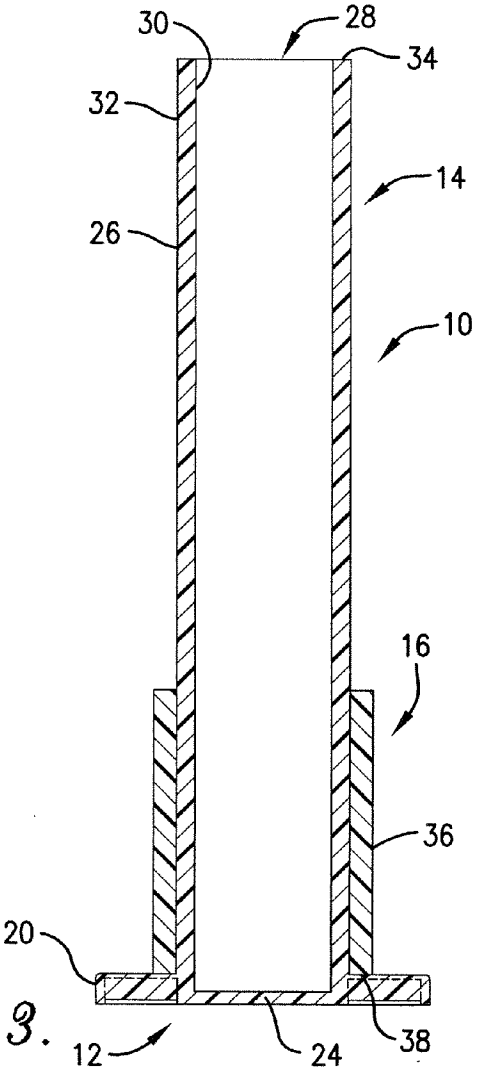
FIG. 3 is a side elevation view of the fireworks launcher of FIGS. 1-2 taken in vertical section.
Figure 2:
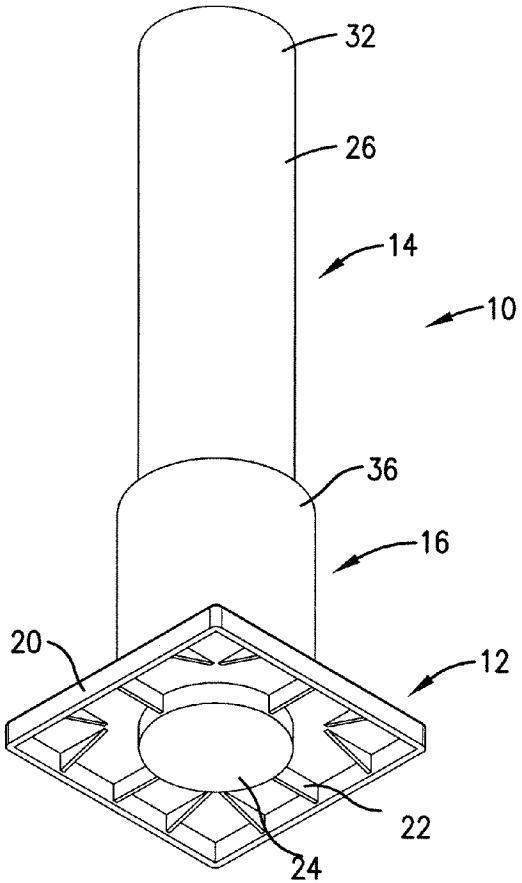
FIG. 2 is a bottom perspective view of the fireworks launcher illustrated in FIG. 1.
Figure 1:
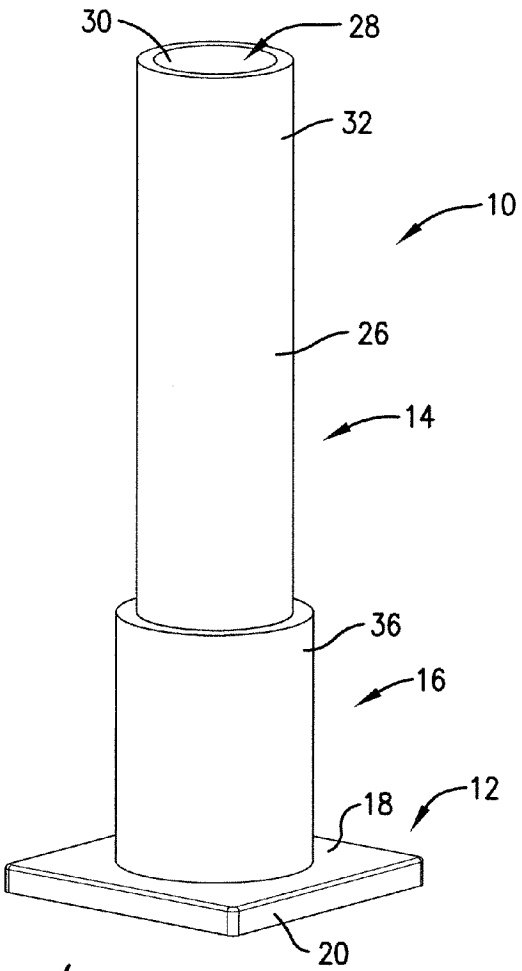
FIG. 1 is a side perspective view of a fireworks launcher of the present invention.

Turning now to the drawings and initially to FIGS. 1-3, a fireworks launcher in accordance with the present invention is designated broadly by the numeral 10. The launcher 10 includes a base 12 adapted to rest upon the ground or another stable support surface and an upstanding, open-top launch tube 14 secured to the base 12. The launch tube 14 is supplemented with a reinforcing section 16 extending upwardly from base 12 and placed in close, conforming relationship to the exterior of the launch tube 14.

The base 12 is of quadrate configuration, including a top wall 18 and a depending sidewall structure 20. The underside of base 12 is equipped with a series of reinforcing webs 22 as can best be seen in FIG. 2. Launch tube 14 is of an integral design, including a circular base 24, and an upstanding tubular wall 26 presenting an open top 28. The tubular wall 26 has opposed inner and outer surfaces 30 and 32 that define a wall thickness 34. As best illustrated in FIG. 3, the lower end of launch tube 14 is centrally located in base 12 with the lowermost surface of base 24 being essentially coincident with the bottom margin of the sidewall structure 20.

The base 12 and launch tube 14 are of integral or integrated construction, and are preferably formed of high density polyethylene. In one embodiment, the base 12 and launch tube 14 are injection molded as a unitary piece. In other embodiments, the base 12 and launch tube 14 are separately formed and then integrated together in various suitable processes. For example, a heat welding process may be used in which the portions of base 12 and launch tube 14 to be joined together are heated and brought into contact with each other. As another example, a frictional welding process may be used in which the launch tube 14 is rotated at high speed while pressed against the base 12. In a further example, a suitable adhesive may be used to join the base 12 with the launch tube 14.

The reinforcing section 16 is in the form of a tubular sleeve 36 having a thickness 37, and may also be formed of high density polyethylene. The sleeve 36 is dimensioned so as to be in tight engagement with the outer surface 32 of launch tube 14. Moreover, the lower butt end 38 of the sleeve rests atop top wall 18 of base 12. The sleeve 36 may be integrally molded with the launch tube 14 or it may be formed separately and then inserted onto the launch tube 14 and secured in place by any suitable means. In one example, a suitable adhesive is used to secure the sleeve 36 to the launch tube 14. In another example, the sleeve 36 is injection molded and pressed onto the launch tube 14 while it is still at an elevated temperature after removal from the mold. As the sleeve 36 cools, it shrinks and tightly engages the launch tube 14.

In preferred forms, the sleeve 36 should have a height which is at least about 20% (more preferably from about 25-50%) of the total height of tubular wall 26. Furthermore, the combined thicknesses 34 and 37 of the launch tube 14 and sleeve 36 should be at least about 40% (preferably from about 45-70%) greater than the thickness 34 of the launch tube 14.

Figure 4:
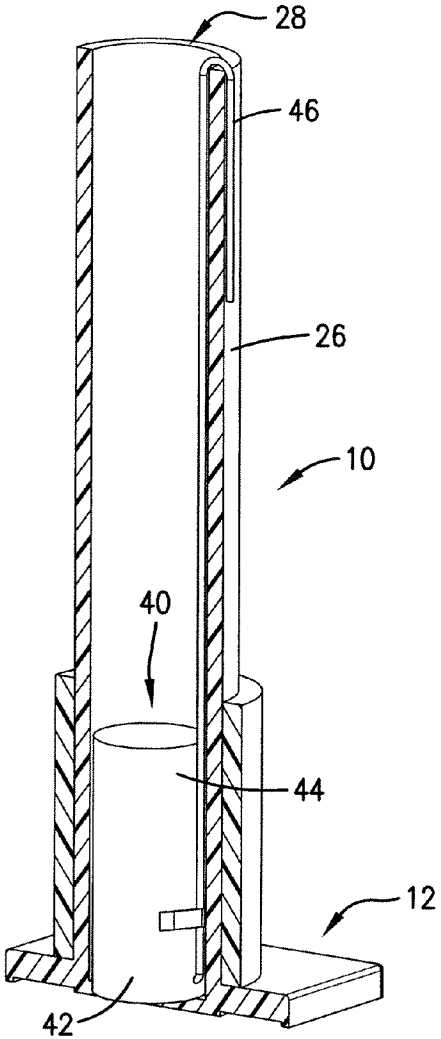
FIG. 4 is a side perspective view of the fireworks launcher taken in vertical section and illustrating proper placement of a fireworks artillery shell within the launcher with the lift charge of the shell positioned below the effect charge thereof.

The launcher 10 is designed to launch a consumer fireworks artillery shell, such as the shell 40 illustrated in FIG. 4. Shells of this type include a lower lift charge 42 and an upper effect charge 44, as well as an elongated ignition fuse 46 of a length to extend out of the open top 28 of the tubular wall 26 of the launch tube 14.

Lift charge 42 is conventional and may be of different compositions as determined by the manufacturer. One suitable lift charge for a consumer fireworks artillery shell would typically contain between 5-10 g (more usually about 8 g) of a black powder charge or suitable alternative, such as a composition having about 74% by weight potassium benzoate, 6% sulfur, and 20% carbon (preferably charcoal).

The fuse 46 is typically formed of twisted paper or fabric material coated with black powder or the like, and is operably connected with lift charge 42, so that lighting of the fuse 46 leads to ignition of the lift charge 42.

The effect charge 44 may have many different components and compositions, as is well known to those skilled in the art. For example, an effect charge may have a bursting charge with a plurality of pearl charges, which, after ignition, present the appearance of colored streams or stars. However, the invention is in no way limited to the type or design of any effect charge. An exemplary fireworks artillery shell is disclosed in U.S. Pat. No. 6,912,958, the entirety of which is incorporated by reference herein.

The use of launcher 10 for the proper launching of a shell 40 is illustrated in FIG. 4. As illustrated, the shell 40 is placed within launch tube 14 with the lift charge 42 positioned below the effect charge 44 and with the ignition fuse 46 extending upwardly and out of the open end 28 of the launch tube 14. The user simply lights the ignition fuse, and this in turn ignites the lift charge 42. This propels the effect charge into the night sky, normally a significant height of 100 ft. or more. At this point, the effect charge 44 is ignited, typically through use of an internal timing fuse (not shown) within the shell 40. Owing to the strong construction of launcher 10, it may be used multiple times with successive shells 40.

Figure 5:
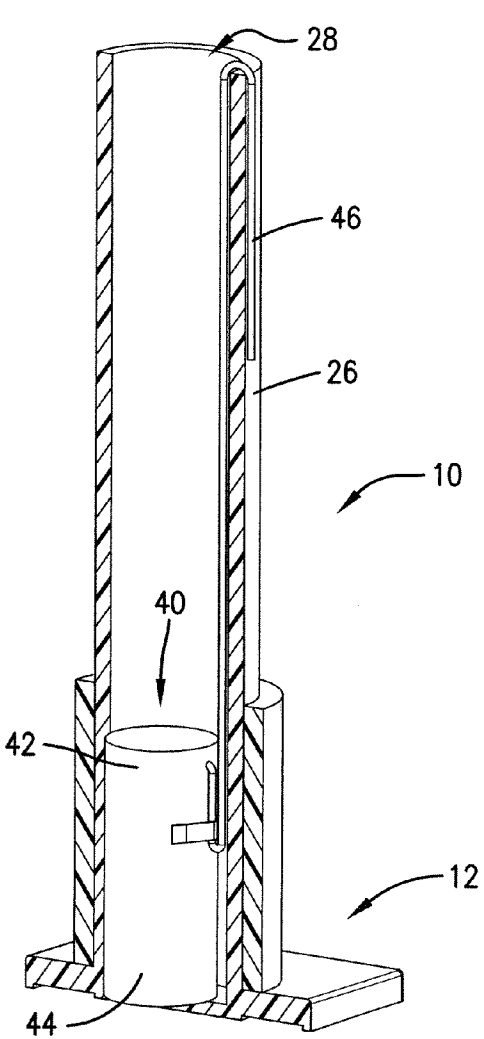
FIG. 5 is a view similar to that of FIG. 4, but illustrating an improper inverted placement of a fireworks artillery shell within the launcher with the lift charge of the shell positioned above the effect charge.

As explained, however, in some instances, the shell 40 may be improperly placed within launch tube 14, in an inverted condition where the lift charge 42 is positioned above the effect charge 44. This condition is illustrated in FIG. 5. Such improper placement of the shell 40 may result from the darkened condition at the launch site, or haste or inattention on the part of the operator. In any event, following lighting of ignition fuse 46, the lift charge 44 and then the effect charge 44 ignite and generate very significant downwardly and laterally projecting forces within the confines of tube 14. These potentially destructive forces can be exerted over several seconds of time with combustion products passing out of the tube 14 through open top 28.

However, provision of the reinforcing section 16 prevents catastrophic failure of the launcher 10 in such a situation, by resisting the destructive forces and maintaining the structural integrity of the launcher 10. Furthermore, the launcher 14 may again be reused after such an accidental occurrence, simply by removing any waste materials from the tube 14.

Figure 6:
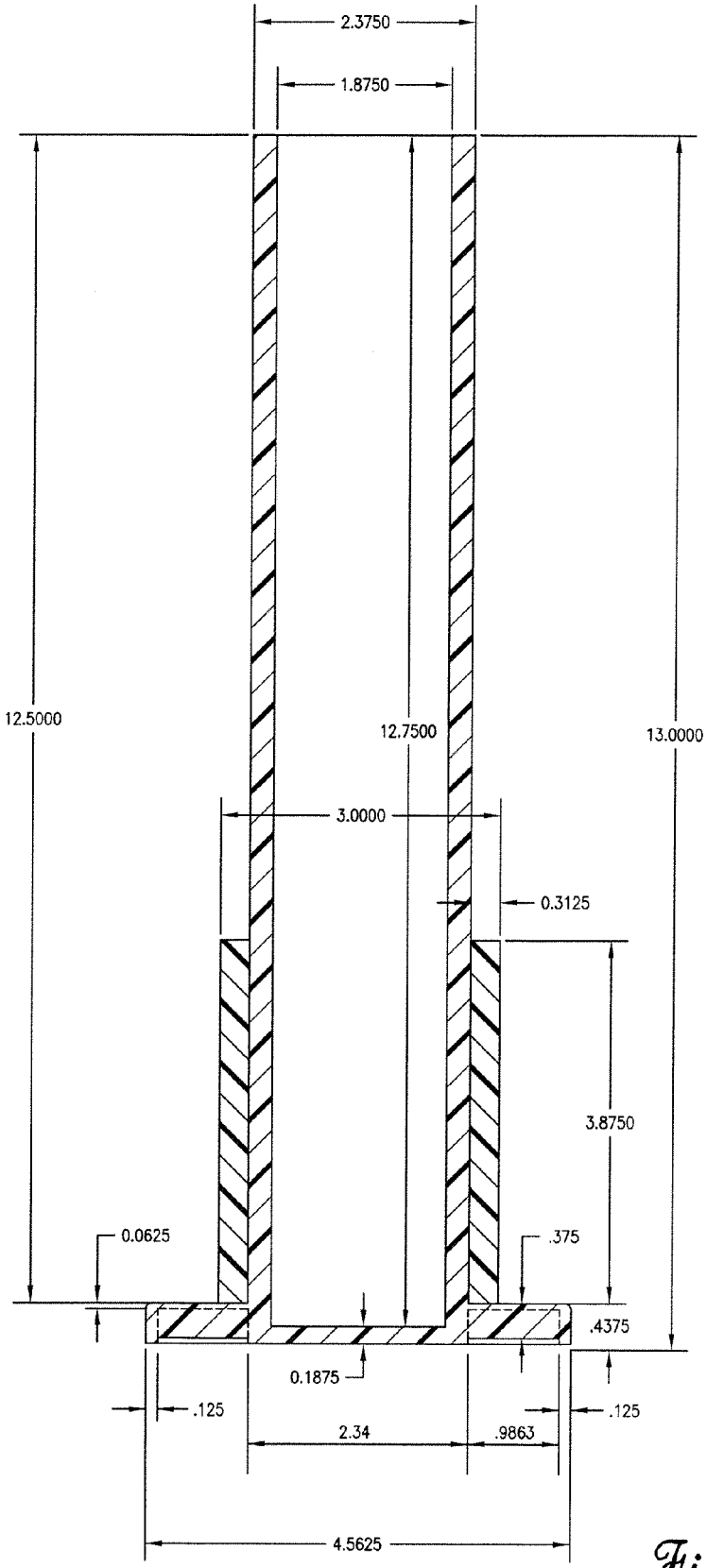
FIG. 6 is a side elevation view similar to that of FIG. 3, illustrating the dimensions of the fireworks launcher.

FIG. 6 illustrates one embodiment of the launcher 14 dimensions in accordance with the invention, it being understood that all components are formed of high density polyethylene. Also, while the specific embodiment illustrated makes use of a sleeve 36 which is structurally separate from the tube 14, as noted above the invention is not so limited; that is, the entire launcher 10 may be integrally formed, wherein the reinforcing section 16 would be integral with launch tube 14.

It will thus be seen that the present invention provides an improved fireworks launcher which overcomes the deficiencies of prior art launchers and ensures the safety of launcher users and fireworks show attendees, even in the event of an improper, inverted placement and ignition of an artillery shell.

What is claimed is:

1. A fireworks launcher operable to launch a fireworks artillery shell having a lift charge and an effect charge, said launcher comprising:

a base;

an elongated, upright launch tube secured to said base and configured to receive said shell, said launch tube having a tubular wall presenting an uppermost open end remote from said base, an inner surface and an outer surface, and a tubular wall thickness between said inner and outer surfaces; and a reinforcing section extending upwardly from said base and having an inner surface in engagement with a portion of said outer surface of the tubular wall of the launch tube above said base, said launch tube being operable to permit ignition and launching of said shell when properly placed within said launch tube with said lift charge beneath said effect charge, the combined thickness of said tubular wall and said reinforcing section being sufficient to withstand potentially destructive forces generated within said launch tube in order to maintain the structural integrity of the launcher, in the event that said fireworks artillery shell is improperly placed within said launch tube and ignited in an inverted condition with said lift charge disposed above said effect charge.

2. The fireworks launcher of claim 1, wherein said reinforcing section is integrally molded with the launch tube.

3. The fireworks launcher of claim 1, the inner surface of said tubular body being adhesively connected with said tubular wall outer surface.

4. The fireworks launcher of claim 1, wherein said tubular wall and said reinforcing section are formed of high density polyethylene.

5. The fireworks launcher of claim 1, wherein said reinforcing section is positioned in abutting contact with said base.

6. The fireworks launcher of claim 1, wherein said reinforcing section has a height which is at least about 20% of the total height of said tubular wall.

7. The fireworks launcher of claim 1, wherein said combined thickness of said tubular wall and said reinforcing section is at least about 40% greater than said tubular wall thickness.

8. The fireworks launcher of claim 1, wherein the reinforcing section has a height which is from about 25% to 50% of the total height of said tubular wall.

9. The fireworks launcher of claim 1, wherein said combined thickness of said tubular wall and said reinforcing section is about 45% to 70% greater than said tubular wall thickness.

10. A fireworks launcher operable to launch a fireworks artillery shell having a lift charge and an effect charge, said launcher comprising:

a base;

an elongated, upright launch tube secured to said base and configured to receive said shell, said launch tube having a tubular wall presenting an uppermost open end remote from said base, an inner surface and an outer surface and a tubular wall thickness between said inner and outer surfaces; and a reinforcing section extending upwardly from said base and in surrounding relationship to a portion of said outer surface of the tubular wall of said launch tube above said base, said reinforcing section comprising a tubular body having an inner surface in engagement with said tubular wall outer surface, said launch tube being operable to permit ignition and launching of said shell when properly placed within said launch tube with said lift charge beneath said effect charge, the combined thickness of said tubular wall and said reinforcing section being sufficient to withstand potentially destructive forces generated within said launch tube in order to maintain the structural integrity of the launcher, in the event that said fireworks artillery shell is improperly placed within said launch tube and ignited in an inverted condition with said lift charge disposed above said effect charge.

11. The fireworks launcher of claim 10, wherein said tubular wall and said reinforcing section are formed of high density polyethylene.

12. The fireworks launcher of claim 10, wherein said reinforcing section is positioned in abutting contact with said base.

13. The fireworks launcher of claim 10, wherein said reinforcing section has a height which is at least about 20% of the total height of said tubular wall.

14. The fireworks launcher of claim 10, wherein said combined thickness of said tubular wall and said reinforcing section is at least about 40% greater than said tubular wall thickness.

15. The fireworks launcher of claim 10, wherein the reinforcing section has a height which is from about 25% to 50% of the total height of said tubular wall.

16. The fireworks launcher of claim 15, wherein said combined thickness of said tubular wall and said reinforcing section is about 45% to 70% greater than said tubular wall thickness.

17. A fireworks launcher operable to launch a fireworks artillery shell having a lift charge and an effect charge, said launcher comprising:

a base;

an elongated, upright launch tube secured to said base and configured to receive said shell, said launch tube having a tubular wall presenting an uppermost open end remote from said base, an inner surface and an outer surface and a tubular wall thickness between said inner and outer surfaces; and a reinforcing section extending upwardly from said base and in surrounding relationship to a portion of said outer surface of the tubular wall of said launch tube above said base, said reinforcing section comprising a tubular body having an inner surface in engagement with said tubular wall outer surface, wherein said reinforcing section has a height which is at least about 20% of the total height of said tubular wall, said launch tube being operable to permit ignition and launching of said shell when properly placed within said launch tube with said lift charge beneath said effect charge, the combined thickness of said tubular wall and said reinforcing section being sufficient to withstand potentially destructive forces generated within said launch tube in order to maintain the structural integrity of the launcher, in the event that said fireworks artillery shell is improperly placed within said launch tube and ignited in an inverted condition with said lift charge disposed above said effect charge.

18. The fireworks launcher of claim 17, wherein said tubular wall and said reinforcing section are formed of high density polyethylene.

19. The fireworks launcher of claim 18, wherein said reinforcing section is positioned in abutting contact with said base.

20. The fireworks launcher of claim 17, wherein said combined thickness of said tubular wall and said reinforcing section is at least about 40% greater than said tubular wall thickness.

* * * * *